United States Patent [19]

Hon

[11] Patent Number: 5,065,844

[45] Date of Patent: Nov. 19, 1991

[54] HYDRAULIC PLATFORM AND LEVEL CORRECTING CONTROL SYSTEM

[75] Inventor: Clarence C. Hon, Cherry Hill, N.J.

[73] Assignee: Mobil Oil Corporation, Fairfax, Va.

[21] Appl. No.: 431,110

[22] Filed: Nov. 3, 1989

[51] Int. Cl.[5] ..... B66B 11/04

[52] U.S. Cl. ..... 187/17; 254/89 H; 91/171

[58] Field of Search ..... 187/17, 8.41, 8.59; 254/89 R, 89 H, 93 R; 269/24; 182/2, 141; 91/171

[56] References Cited

U.S. PATENT DOCUMENTS

| | | | |
|---|---|---|---|
| 3,241,458 | 3/1966 | Goldie | 91/171 |
| 3,265,357 | 8/1966 | Schilling | 254/89 H |
| 3,289,868 | 12/1966 | Miller et al. | 254/89 H |
| 3,961,670 | 6/1976 | Rivinius | 91/171 |
| 4,679,489 | 7/1987 | Jasinski et al. | 91/171 |

*Primary Examiner*—Robert P. Olszewski
*Assistant Examiner*—Kenneth Noland
*Attorney, Agent, or Firm*—Alexander J. McKillop; Charles J. Speciale; Jessica M. Sinnott

[57] ABSTRACT

A hydraulic platform and level correcting system used for a wide variety of lifting applications that require a steady, level lift in order to avoid damage to the lift and/or an object being lifted. The hydraulic platform is controlled by an electrohydraulic control system which includes a hydraulic pump under the control of an electric control circuit to provide the lifting force necessary for hydraulic platform operation as well as a device for automatically correcting the level of the hydraulic platform.

23 Claims, 2 Drawing Sheets

HYDRAULIC PLATFORM AND LEVEL CORRECTING CONTROL SYSTEM

BACKGROUND OF THE INVENTION

1. Field of the Invention

The present invention relates to hydraulic lifts and to control systems for automatically correcting the level of a twin-post hydraulic cylinder lift platform, and more particularly, pertains to an electrohydraulic control system for detecting and correcting incremental changes in hydraulic lift platform level orientation without any potential damage to the platform or any object which may be located on the platform.

2. Discussion of the Prior Art

Hydraulic platforms are employed in a variety of applications requiring varying degrees of stability and lifting power. Thus, hydraulic lifting platforms are used in the most diverse applications which range from their use on loading docks to their employment on aircraft carriers. In all of these utilizations, it is necessary to maintain a level platform to prevent damage to any object being lifted or supported thereon, to prevent damage to the hydraulic lift structure itself, and to ensure the safety of the personnel operating and utilizing the lift.

There are numerous conditions under which a hydraulic platform may be caused to tilt in any particular direction. A clearly obvious reason for causing a platform to tilt is an unequal distribution or shifting of a load which is arranged on the platform, and this tilting situation may, at times, become unavoidable for certain lifting applications. Other conditions which may cause the platform to tilt are internally inherent to the system structure. Thus, the tilting can be a result of normal wear of parts at different wear rates over a lengthy period of time, hydraulic line breakage or leakage at one of the hydraulic cylinders, or a jammed or defective valve on one operating side of a hydraulic pump. Normal wear as defined herein includes wear of the moving parts of the pump, and wear of the internal parts of each hydraulic cylinder, such as the pistons, the cylinder walls and the seals. In addition, the normally encountered leakage rate of hydraulic fluid from each cylinder may be slightly different, and therefore, over a lengthy period of time, may result in a significant degree of tilt predicated on the cumulative effect of many cycles of operation.

Presently hydraulic lifts rely primarily on the physical construction of the lift itself in order to maintain the level condition of the platform. The stiffness and strength of the components constituting the hydraulic lift, as well as the pressure created by the hydraulic pump, impart the platform with a level lift. Moreover, most hydraulic lifts employ some type of mechanical safety stop or break to prevent extreme slippage of the platform. The mechanical safety stop or break may consist of a type of spring-loaded safety bar in the pistons or a separate support rack which is adapted to be positioned beneath the hydraulic lift. The safety stop or break which is used to prevent extreme slippage of the platform usually does not incorporate structure or function for preventing or correcting less severe degrees of tilting of the platform. Therefore, in the technology there is presently no structure available which will produce and maintain an exact degree of platform levelness required by certain lifting applications.

SUMMARY OF THE INVENTION

Accordingly, an object of the present invention is directed to the provision of a hydraulic lifting platform using a pair of double-acting hydraulic cylinders, and incorporating a level correcting system comprising a pair of tilt detecting switches, and an electrohydraulic control system or servomechanism responsive to the function of the tilt detecting switches to correct any tilting and maintain the platform at a level orientation. The basic system comprises a platform which is raised and lowered by the pair of double acting hydraulic cylinders, and includes a pair of tilt detecting switches conveniently mounted in the platform at locations which will provide information relative to incremental degrees of tilt of the platform. The system also provides an electrohydraulic control system or servomechanism which is employed to control the raising and lowering of the platform as well as maintaining the platform in a level condition. The electrohydraulic control system or servomechanism contains a hydraulic pump which is driven by an electric motor which is a component of an electric motor control circuit which is responsive to the tilt detecting switches and operator controls. Alternatively, the hydraulic pump may also be driven by other suitable motion generating devices, such as steam turbines or the like.

During the normal mode of operation of the platform, an operator depresses either the "up" or "down" button on a control panel and the platform responds in conformance therewith. If for some reason the platform starts to tilt, the appropriate tilt detecting switch causes platform operation to be immediately suspended, thereby preventing any structural damage to the platform or to an object which is located on the platform. A physical inspection of the platform is conducted by the lift operator, and upon detection of the cause of the tilting, the operator removes or repairs the cause of the malfunction. The operator then depresses the "down" button (or "up" bottom if the control logic is so designed) which automatically causes the higher piston to be lowered by a predetermined amount. The control of the exact amount of travel over the piston is set by a timing circuit. The operator continues to depress the "down" button until a level indicator light shows that the platform is once again level, indicated by the extinction of tilt light. The system accomplishes the tilt correction by preferentially activating the hydraulic piston at the high end of the platform until it results in a level position.

The inventive hydraulic lifting platform employing a pair of double-acting hydraulic cylinders and having a level correcting system provides a safe and simple arrangement for ensuring level operation of a hydraulic lifting platform. The hydraulic lifting platform and electrohydraulic control system or servomechanism offers several advantages over purely electrical or mechanical systems, including a greater mechanical advantage in lifting ability, and enhanced reliability. Moreover, such hydraulic systems are particularly useful in conjunction with distributed systems which encompass a relatively large surface area inasmuch as the hydraulic pressure generated by the pump is subject to lower pressure losses over distance than would a purely mechanical system. The hydraulic lifting platform incorporates a simple and easily employable control system for providing a rapid, safe and reliable control over the functioning of the platform.

The hydraulic lifting platform can be readily employed in a wide variety of applications including, but not limited to, loading docks installations, truck and trailer gates, aircraft carrier lifts for cargo and aircraft, construction machinery, ships, farm equipment, and gas station lifts. The hydraulic lifting platform is adapted to be employed in any application where it is absolutely necessary to ensure that the article being lifted be maintained at a level orientation. One such example of where it is absolutely necessary to ensure a level lift is in the relocating of a house. Thus, were the lift not to be level, there could be encountered severe structural damage to the house.

BRIEF DESCRIPTION OF THE DRAWINGS

Reference may now be had to the following detailed description of an exemplary embodiment of the invention, taken in conjunction with the accompanying drawings; in which.

DESCRIPTION OF THE PREFERRED EMBODIMENT

Figure 1:
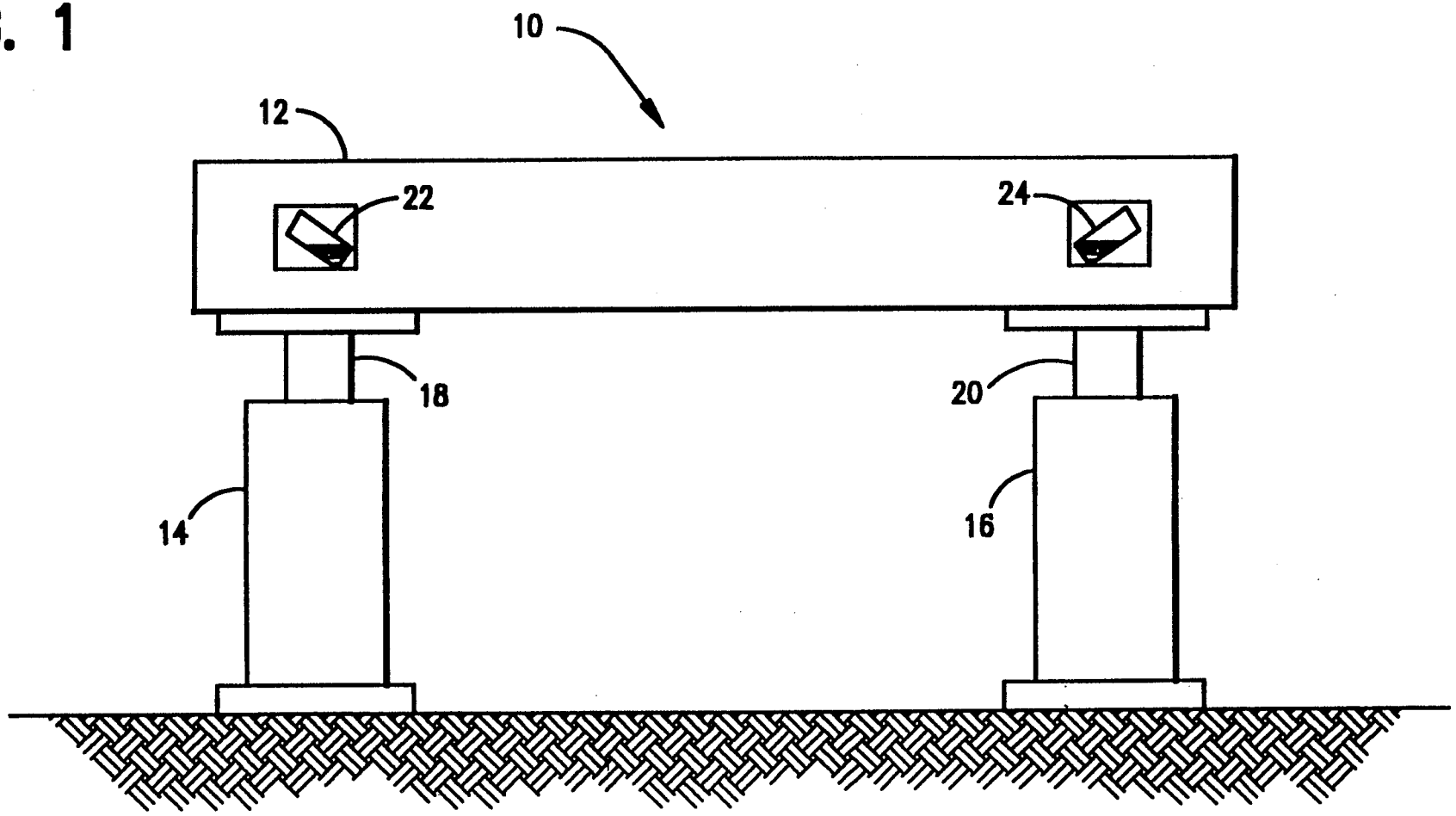
FIG. 1 illustrates a diagrammatic representation of the hydraulic platform pursuant to the present invention.

Referring to FIG. 1, there is illustrated a typical hydraulic lifting platform 10 comprising a platform 12 which is supported by twin double-acting hydraulic cylinders 14 and 16. The hydraulic cylinders 14 and 16 have pistons 18 and 20 contained therein which, under the action of hydraulic pressure, either raise and lower the platform 12. Two tilt detected switches, 22 and 24, such as electrically-conductive liquid switches; for example, in the form of mercury switches, are respectively attached to each end of the platform 12. When the platform 12 is level, both switches 22 and 24 are normally in the conductive state which allows for normal operation of the hydraulic lifting platform 10. When either end of the platform 12 tilts, then the tilt detecting switch 22 or 24 at that particular end opens up the circuit and prevents normal operation of the hydraulic lifting platform 10. By way of example, when the tilt detecting switches consist of mercury switches, if for some reason the platform 12 tilts on the side of piston 18, the mercury in mercury switch 22 flows to the other side of the switch 22 thereby breaking the electrical circuit in that switch 22. The sensitivity of the mercury switches 22 and 24 can be easily adjusted by turning an adjustment screw located on the mounting assembly of each mercury switch 22 or 24. Although the adjustment screw is not shown in the drawing, turning the screw in a clockwise or counter clockwise direction causes that particular mercury switch 22 or 24 to rotate in the corresponding direction.

Mercury switches are generally selected as the preferred type of tilt detecting switches for this application because of the electrically-conductive properties of mercury, and inasmuch as mercury remains in a liquid state over a wide temperature range, although other types of switches are readily employable. Other electrically-conductive liquids possessing different viscosities can also function as the conductive media, and by choosing the correct viscosity, it is possible to adjust the sensitivity of the switches to take cognizance of the effects of vibration, inasmuch as the effects of any possible vibrations should be considered from the point of view of encountering false alarm stops during the operation of the hydraulic lifting platform. In the absence of proper damping of the system, high-amplitude vibrations can be encountered, thereby possibly resulting in opening one or both of the mercury switches 22 or 24. One form of damping can be in the employment of a high-viscosity liquid in the tilt detecting switches, such as mercury, which is less likely to be shaken by vibrations, or through the interposition of an electronic filtering device in which the signals emitted from the tilt detecting switches are smoothed electrically before being transmitted to the next element of circuitry.

Figure 2:
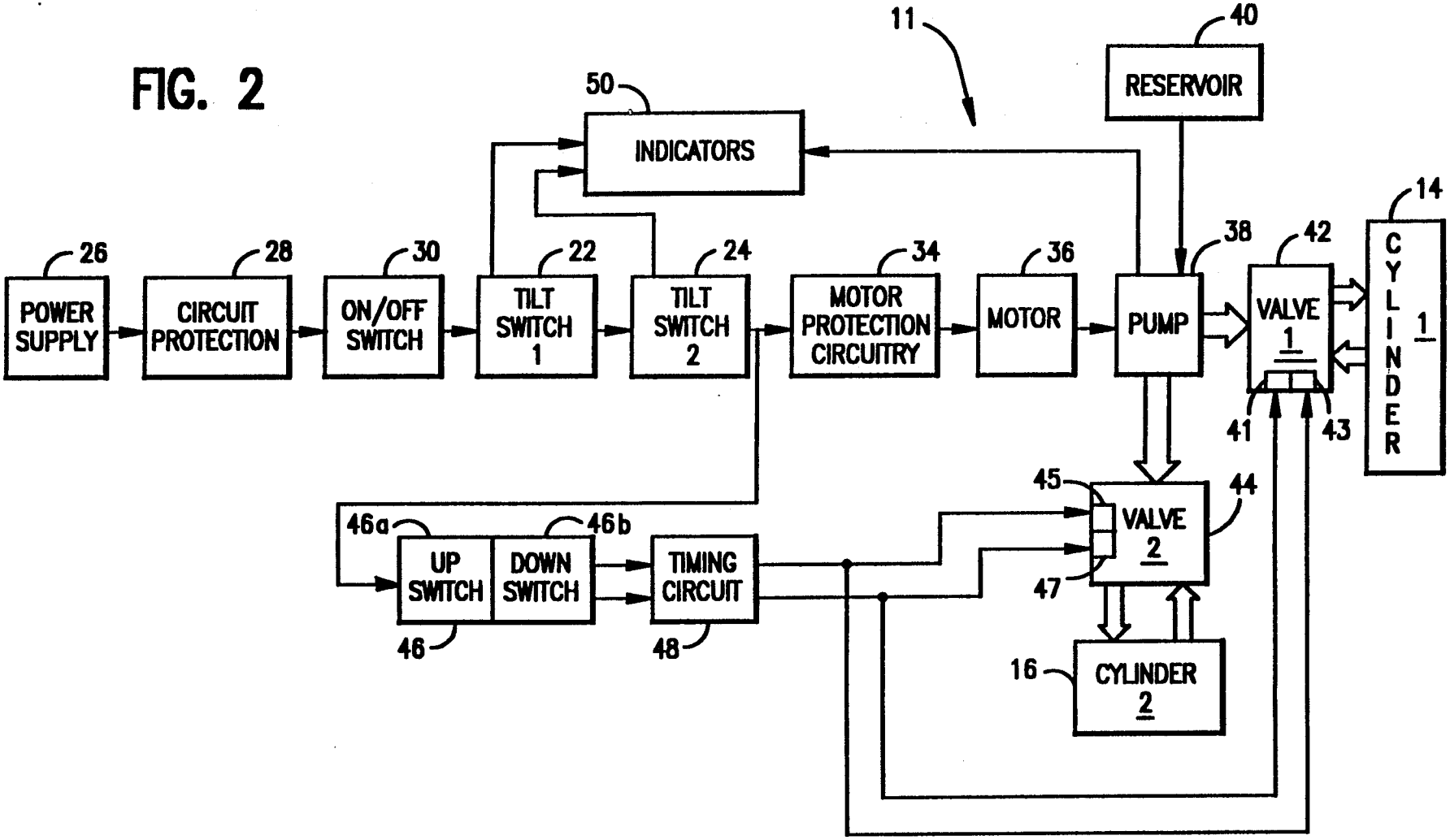
FIG. 2 illustrates a block diagram of the level correcting control system for the hydraulic platform.

Referring now to FIG. 2, there is shown a block diagrammatic representation of the motor control circuit 11 for control the hydraulic lifting platform 10 of FIG. 1. The power for the motor control circuit 11 is provided from any standard electric power source, such as power supply 26. In order to prevent any possible damage to the remaining circuitry, the power supply 26 is electrically isolated or protected from the remaining circuitry by a suitable circuit protection device 28, which may be a fuse or circuit breaker. The electrical power supplied to the circuit 11 is controlled by an in-line on/off switch 30 which, in the on state thereof, closes the circuit to thereby allow current to flow and, in the off state, opens the circuit to prevent current from flowing. The on/off switch 30 may be any type of standard electrical switch.

The tilt detecting switches in the form of mercury switches 22 and 24 which are shown in FIG. 1 are also shown in FIG. 2. The mercury tilt switches 22 and 24 as stated hereinabove are in the conductive state when the platform 12, shown in FIG. 1, is level. When either side or end of the platform 12 tilts, the mercury tilt switch 22 or 24 on that particular side or end of the platform 12 opens up into an electrically non-conductive state, thereby producing an open circuit in the motor control circuitry 11. The output of the second mercury tilt switch 24, is connected to a motor protection circuit 34.

The mercury tilt switches 22 and 24 are also connected to a bank of indicator lights which indicate to the lift operator the existence of a tilt condition, and more particularly, which side of the platform is tilting. The tilt indicator lights can be light-emitting diodes (LED's) or standard light bulbs. In addition, the lights can be hooked up in conjunction with a suitable audio alarm system whereby, in case the operator does not notice the tilt light, the alarm tone will sound a warning to the operator. The tilt indicating lights are part of the system indication circuitry 50. It is important to have some type of indication means 50 because, if the platform 12 does tilt and hydraulic lift operation is suspended, damage could be encountered by the entire motor control circuit 11 since power is still being supplied to the system.

The motor protection circuit 34 may be a standard overvoltage/overcurrent protection circuit, which usually consists of relay circuits which automatically open when an overload condition exists, thereby preventing serious damage to the motor and to the entire system. The electric motor 36 is a standard ac or dc electric motor, which can be either a single-phase or three-phase motor depending upon the case of application and the available power supply. The ac-induction motor is the most common type of motor currently employed, since it is available in sizes ranging from fractions of a horsepower up to several thousand horsepower. Usually in applications which require larger horsepower motors, typically above 5.0 horsepower, there are utilized three-phase ac-induction motors whereas for smaller applications, there are used single-phase ac-induction motors. DC motors are used when one wants to adjust the speed of piston travel. Therefore, the choice of which motor is employed depends largely upon the requirements of the entire system and the type of power supply which is available.

The electric motor 36 is supplied for the control or operation of a hydraulic pump 38. The hydraulic pump 38 is a twin-positive displacement hydraulic pump which delivers hydraulic fluid to the hydraulic cylinders 14 and 16 at constant and equal flow rates and volumes. The hydraulic pump 38 under the control of the electric motor 36 provides a constant flow rate and equal volumes of hydraulic fluid to each of the hydraulic cylinders 14 and 16 respectively by way of valves 42 and 44. The hydraulic fluid for the pump is supplied from a hydraulic fluid reservoir 40. The hydraulic pump 38 is also selected based on system requirements such as fluid flow rate and required hydraulic pressure. In conformance with the choice of electric motors, there is also available a selection from a wide variety of pumps depending on the particular application. It should be noted that there are pumps which have electric motors built into the same unit and therefore, it may not necessary to supply separate motors and pumps. The motor/-pump combinations offer the same flexibility in terms of system performance as those with discrete components, but the entire unit must be concurrently replaced, if damaged or broken, regardless if either the motor or pump of the unit is still functioning. The system indication circuitry 50 described hereinabove also contains a pump running indicating light which alerts the lift operator that the pump is functioning properly. As mentioned previously, instead of an electric motor, it is also possible to contemplate the provision of other types of motion generating devices such as, for example, steam turbines.

The hydraulic system of the present invention, including the hydraulic pump 38, the hydraulic fluid reservoir 40, the hydraulic fluid valves 42 and 44 and hydraulic cylinders 14 and 16 form a closed system. As in any closed system which is under pressure, certain precautions must be taken in order to avoid system damage caused by possible explosions. In this instance, pressure-relief safety valves are built into various locations in the system. These safety valves, which are not shown in the illustration of FIG. 2, simply vent any excess pressure which has built up above a certain threshold level, and then vent this excess pressure to the surroundings so as to thereby reduce any chances of a system blowout.

The hydraulic pump 38 pumps the hydraulic fluid to the two hydraulic valves 42 and 44. The hydraulic valves 42 and 44 are twin solenoid 4-way valves for porting the fluid to the two hydraulic cylinders 14 and 16. The hydraulic pump 38 circulates the hydraulic fluid from a central fluid reservoir 40 to each of the twin solenoid 4-way valves 42 and 44. The twin solenoid 4-way valves 42 and 44 have two lines for supplying and removing hydraulic fluid from each of the cylinders 14 and 16. Twin solenoid 4-way valve 42 contains a solenoid 41 which, if activated, causes the valve 42 to port fluid to the cylinder 14 in order to raise the piston contained therein. Twin solenoid 4-way valve 44 contains a solenoid 45 which is activated at the same exact instant that solenoid 41 is activated, and causes valve 44 to port fluid to cylinder 16 in order to raise the piston contained therein. Solenoids 43 and 47, when activated, produce an opposite effect in that they cause the pistons of cylinders 14 and 16 to be lowered. Basically, operating one valve solenoid on each of the twin solenoid 4-way valves 42 and 44 raises the pistons of each of the hydraulic cylinders 14 and 16, while actuating the second valve solenoid on each of the twin solenoid 4-way valves 42 and 44 lowers the hydraulic pistons of each of the hydraulic cylinders 14 and 16. The solenoids 41, 43, 45 and 47 of the twin solenoid 4-way valves 42 and 44 are electrically controlled from the same electrical power which supplies the electric motor 36; in essence, the power supply 26.

An "up" switch **46*a* and "down" switch 46*b* are used to control power supplied to each of the solenoids 41, 43, 45 and 47 of the twin solenoid 4-way valves 42 and 44, and are basically standard electrical switches. The "up" and "down" switches 46*a* and 46*b* each receive their electrical power from the output of the second mercury tilt switch 24. The two signal lines output from the "up" and "down" switches 46*a* and 46*b* are output to a timing circuit 48. A timing circuit 48 allows the power furnished to the twin solenoid 4-way valves 42 and 44 to be supplied for a predetermined length of time corresponding to a specific length of travel for the pistons. This distance typically may be 1/32 to 1/16 of an inch. Since it is desired to provide precise upward or downward movement of the hydraulic pistons, both twin solenoid 4-way valves 42 and 44 are interlocked with electrical relays (not shown) which ensure complete synchronization between the twin solenoid 4-way valves 42 and 44**.

The timing circuit 48 may be a standard digital timing circuit which for practical purposes, may in this type of application be adjusted to be operated within a time interval of 0.1 to 10.0 seconds. The length of time selected depends upon the slew rate of the pistons in the hydraulic cylinders 14 and 16. For example, if the pistons of the hydraulic cylinders 14 and 16 move a 1/16 of an inch in 1.0 second, and it is desired that each time the down switch 46 is depressed the pistons should retract 1/32 of an inch, then the timing circuit 48 should be set for 0.5 seconds. Basically, the timing circuit 48 allows the solenoids 41, 43, 45 and 47 of the twin solenoid 4-way valves 42 and 44 to be energized for a specific length of time, as discussed hereinabove. Once the time interval has expired, then in order to move the pistons any farther, the "down" switch **46*b*** must be depressed again.

During normal operation, the lift operator will either turn on the system using on/off switch 30 or, alternatingly, turn off the system using on/off switch 30. When the operator turns the system off, then the lift operation is suspended and no power is drawn. On the other hand, if the operator decides to utilize the lift, then by turning the system on, power is supplied to the entire system. If the platform 12 is level current will then flow through the tilt detecting switches or mercury tilt switches 22 and 24 to the electric motor 36, and also to the "up" and "down" switches **46*a* and 46*b*. Since power is supplied to the electric motor 36, the pump 38 is operational as indicated by the pump running indication light; therefore, when the operator presses either the "up" or "down" switch 46*a* or 46*b*, current is supplied to two of the four solenoids 41, 43, 45 and 47 of the twin solenoids 4-way valves 42 and 44. With the particular solenoids energized, the valves 42 and 44 port the hydraulic fluid supplied by the hydraulic pump 38 to the cylinders 14** and 16 to either raise or lower the pistons contained therein. The platform 12 can be continuously raised or lowered as long as the platform 12 does not tilt.

When, during operation, the platform 12 tilts in any direction, then one or both of the mercury tilt switches 22 or 24 will open, and supply of power to the motor 36 and to the solenoids 41, 43, 45 and 47 is immediately terminated, thereby suspending lift operation. Upon a system operation suspension taking place, the operator is alerted by the tilt indication warning lights and/or alarm. At this point in time, the operator can immediately attempt to restore a level orientation of the platform by turning the system off at power supply 26 and then proceeding to inspect the hydraulic lifting platform 10 for any causes of the tilting. After detection and/or obviating of the cause of the tilting, the operator then turns the system back on.

With the power again reactivated, the operator then depresses the "down" switch 46*b* which, acting through the timing circuit 48, automatically supplies power to the solenoid 41, 43, 45 or 47 of the twin solenoid 4-way valves 42 or 44 which corresponds to the higher of the two pistons contained therein. Each time the "down" button 46*b* is depressed, the higher piston is lowered by a predetermined amount as previously explained. The operator continues to depress the down switch 46*b* until the tilt indicator light turns off, thereby indicating that the platform is once again level. The operator then opens the key switch bypass 32 and normal operation of the lift can resume.

It is an important aspect of the invention that a single mercury tilt switch can be employed instead of two as described in this embodiment of the invention; however, if one mercury switch is utilized instead of two, then the accuracy of tilt detection will in all likelihood be adversely affected, whereas on the other hand, more then two mercury tilt switches on any single side of the platform would be superfluous. However, if more tilt switches are added to a second side of the platform perpendicular to the first side containing switches, multi-axis level orientation may be obtained.

In this invention, only one button, in this example the "down" button, is used for purposes of illustration. However, the circuit may be designed so that by depressing the "up" button this will correct the tilt by raising the low hydraulic piston.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A hydraulic lifting platform utilizing an electrohydraulic control system comprising a pair of double acting hydraulic actuating means for providing the lifting force for said platform, control circuit means for driving said hydraulic actuation means, at least one angular position detection switch, said control circuit means being responsive to said switch, said switch comprising an electrically conductive liquid switch for determining if said platform is tilting in any direction during normal operation and to terminate power to said control circuit means if said platform is tilting whereby platform operation is suspended, and a servomechanism which is responsive to said angular position detection switch for adjusting the level of the platform when a tilt is detected in the platform during normal operation and resuming the normal operation when the platform is level.

2. A hydraulic lifting platform as claimed in claim 1, wherein said switch is a mercury switch.

3. A hydraulic lifting platform as claimed in claim 1, wherein said hydraulic fluid to a pair of hydraulic cylinders to raise and lower said platform; and first and second valve means for controlling the flow of hydraulic fluid from said pump means to said hydraulic cylinders.

4. A hydraulic lifting platform as claimed in claim 3, wherein said control circuit means comprises motor means for driving said pump means, and motor control circuit means which supplies and controls power to said motor means and is responsive to said tilt detection means.

5. A hydraulic lifting platform utilizing a pair of double-acting hydraulic cylinders for lift actuation and having a level correcting system comprising:

tilt detection means connected to said platform for suspending operation of said lifting platform when said platform tilts in any direction during normal operation, said tilt detection means comprising at least one electrically-conductive liquid switch;

and servomechanism means for leveling the platform which is responsive to said tilt detection means and is actuated when the platform tilts and resumes the normal operation when the platform is level.

6. A hydraulic lifting platform as claimed in claim 5, wherein said tilt detection means comprises two electrically-conductive liquid switches.

7. A hydraulic lifting platform as claimed in claim 6, wherein said two-electrically conducting liquid switches are mercury switches.

8. A hydraulic lifting platform as claimed in claim 7, wherein said mercury switches are mounted in said platform above each of the double-acting hydraulic cylinders.

9. A hydraulic lifting platform as claimed in claim 5, wherein said servomechanism means comprises pump means for providing hydraulic fluid under pressure to said pair of double acting hydraulic cylinders to raise and lower said platform; motor means for driving said pump means; and motor control circuit means for controlling said motor means by controlling the power to said motor means and which is responsive to said tilt detection means.

10. A hydraulic lifting platform as claimed in claim 9, wherein said pump means is a twin-positive displacement pump which provides hydraulic fluid to said pair of hydraulic cylinders at constant and equal flow rates and volumes through first and second valve means.

11. A hydraulic lifting platform as claimed in claim 9, wherein said moor means is a single phase ac-electric motor.

12. A hydraulic lifting platform as claimed in claim 9, wherein said motor means is a three phase ac-electric motor.

13. A hydraulic lifting platform utilizing a pair of double-acting hydraulic cylinders for lift actuation and having a level correcting system comprising:

tilt detection means connected to said platform for suspending operation of said platform when said platform tilts in any direction; and servomechanism for controlling the level of said platform and raising or lowering said platform which is responsive to said tilt detection means; comprising, a pump for providing hydraulic fluid under pressure to said pair of double acting hydraulic cylinders to raise and lower said platform; motor means for driving said pump; and motor control circuit means for controlling said motor means by controlling the power to said motor means and which is responsive to said tilt detection means, said pump being a twin-positive displacement pump which provides hydraulic fluid and to said pair of hydraulic cylinders at constant and equal flow rates and volumes through first and second valve means.

14. A hydraulic lifting platform as claimed in claim 13, wherein said first and second valve means are twin-solenoid 4-way valves which control the flow of hydraulic fluid supplied by said displacement pump.

15. A hydraulic lifting platform as claimed in claim 14, wherein said motor control circuit means comprises power supply circuit protection means for electrically protecting said circuit means from extreme variations in a power supplies output; motor protection circuit means for electrically protecting said motor means from overload conditions; switch means for controlling the operation of said motor control circuit means; and means for indicating various conditions present in the motor control circuit means.

16. A hydraulic lifting platform as claimed in claim 15, wherein said switch means comprises an on/off switch for providing or discontinuing power from said power supply to be transmitted to said motor means; an up switch for providing power to a first solenoid of each of the twin solenoid 4-way valves which will cause the hydraulic fluid to be supplied to the hydraulic cylinders in a manner as to cause the platform to be raised, a down switch for providing power to a second solenoid of each of the twin solenoid 4-way valves which will cause the hydraulic fluid to be supplied to the hydraulic cylinders in a manner as to cause the platform to be lowered, and key switch bypass means for bypassing said tilt detection means in order to correct the level of said platform after said tilt detection means suspends operation.

17. A hydraulic lifting platform as claimed in claim 15, wherein said indicating means comprises first and second tilt warning means, and pump running indication means.

18. A hydraulic lifting platform as claimed in claim 17, wherein said first and second tilt warning means are first and second audio alarm.

19. A hydraulic lifting platform as claimed in claim 17 wherein said first and second tilt warning means are first and second audio alarm.

20. A hydraulic lifting platform as claimed in claim 17, wherein said-pump running indication means comprises a pump running indication light.

21. A hydraulic lifting platform as claimed in claim 16, wherein said motor control circuit means comprises a timing circuit facilitating power to be transmitted from said down switch to said second solenoid of each of the twin solenoid 4-way valves for a predetermined time interval corresponding to a predetermined distance of movement for said platform.

22. A hydraulic lifting platform as claimed in claim 21, wherein said time interval ranges from between 0.1 to 10 seconds.

23. A hydraulic lifting platform as claimed in claim 21, wherein said distance of movement ranges from 1/32 of an inch to 1/16 of an inch.

* * * * *

UNITED STATES PATENT AND TRADEMARK OFFICE

CERTIFICATE OF CORRECTION

PATENT NO. : 5,065,844

DATED : November 19, 1991

INVENTOR(S) : Clarence C. Hon

It is certified that error appears in the above-identified patent and that said Letters Patent is hereby corrected as shown below:

Col. 7, Line 59 "Actuating" should read --actuation--

Col. 8, Line 11 After "hydraulic"(1st occurrence) insert --actuation means comprises pump means for providing hydraulic--

Col. 8, Line 58 "moor" --motor--

Col. 10, line 14 After "are" change "first and second audio alarm" to --first and second tilt warning lights--.

Signed and Sealed this

Thirtieth Day of March, 1993

*Attest:*

STEPHEN G. KUNIN

*Attesting Officer*

*Acting Commissioner of Patents and Trademarks*